US005230111A

United States Patent [19]

Davis

[11] Patent Number: 5,230,111

[45] Date of Patent: Jul. 27, 1993

[54] CORNER GRIP FOR FITTED SHEETS AND FITTED MATTRESS COVERS

[76] Inventor: Kenneth E. Davis, 14487 S. Clackamas River Dr., Oregon City, Oreg. 97045

[21] Appl. No.: 901,427

[22] Filed: Jun. 22, 1992

[51] Int. Cl.[5] ..... A47G 9/02

[52] U.S. Cl. ..... 5/497; 5/499

[58] Field of Search ..... 5/495–499

[56] References Cited

U.S. PATENT DOCUMENTS

| | | | |
|---|---|---|---|
| 2,605,483 | 8/1952 | Ridenhour | 5/497 |
| 3,013,283 | 12/1961 | Steffinich | 5/497 |
| 3,142,072 | 7/1964 | Goodson, Jr. . | |
| 3,181,179 | 5/1965 | Roddey, Jr. . | |
| 3,273,175 | 9/1966 | Anderson et al. . | |
| 3,438,068 | 4/1969 | Anderson et al. | 5/497 |
| 3,789,441 | 2/1974 | Weiss | 5/497 |
| 4,045,832 | 9/1977 | DiForti et al. . | |
| 4,494,262 | 1/1985 | Robertson | 5/496 X |
| 4,662,013 | 5/1987 | Harrison . | |
| 4,698,865 | 10/1987 | Walker | 5/495 X |
| 4,703,530 | 11/1987 | Gusman . | |
| 4,809,376 | 3/1989 | Boldra . | |
| 4,912,790 | 4/1990 | Macdonald . | |

*Primary Examiner*—Michael F. Trettel

*Attorney, Agent, or Firm*—Kolisch, Hartwell, Dickinson, McCormack & Heuser

[57] ABSTRACT

A method of constructing fitted sheet corners that cause the upper corners of the fitted sheet to draw more closely to the mattress than is designed into the regular plane of the fitted sheet seam. The recessed effect of this invention causes a slight depression in the softer, more pliable area of the mattress corner. The rigid characteristics of the top of the mattress corner act as a deterrent to the fitted sheet movement in an upward direction. A fitted sheet with this invention interacts with the mattress corners as the fitted sheet and mattress are distorted when used in the intended use.

5 Claims, 2 Drawing Sheets

CORNER GRIP FOR FITTED SHEETS AND FITTED MATTRESS COVERS

FIELD OF THE INVENTION

This invention relates to fitted covers for mattresses and, in particular, to fitted sheets that use a variety of means and constructions to secure the sheet to the mattress and restrict movement of the fitted sheet on the mattress.

DESCRIPTION OF PRIOR ART

In the past various prior arts have been developed that create corners and methods of securing a fitted sheet to the mattress. Elastic bands attached to the lower edges has been used in a variety of cases as a securing and or retaining devise.

Prior arts have also relied on the addition of materials that extend beyond the side and end panels. These additions create a casing effect. Additional materials at the corners create an encasement of the corners. Additional materials extended beyond the side or end panels creates an encasement of the respective side or end of the mattress. This prior art extends under the mattress and depends on the mattress bottom to aid in the retention of the fitted sheet or mattress cover.

Prior arts have used corner seams that are relatively perpendicular to the top of the mattress cover. Other prior arts have used construction with relatively convexed corner seams. Prior art has relied on corner seam construction to uniformly extend the side and end panels over the mattress and create the fitted attributes of the fitted mattress covers.

In all cases the intention is to create a fitted sheet that conforms to the mattress and is retained on the mattress during its intended use. In the past fitted sheets have been developed around the general form of the mattress. The general form of the mattress is a rectangular box when all planes of the mattress are at rest. Thus, fitted sheets conform to this general shape of the mattress when it is at rest. When a mattress and fitted sheet are in the intended use they seldom strictly conform to the rectangular box shape of the mattress when all planes are at rest. Thus, a series of stresses are applied to the fitted sheet that in certain cases cause the sheet to become dislodged or loose from the mattress when in use. Control of this phenomena has only been successful at varying degrees. None of the above mentioned constructions or arts describe the present invention.

SUMMARY OF THE INVENTION

This invention is directed to the corner construction of fitted sheets and a variety of fitted mattress covers. Specifically, the corner grip construction is a novel and unique method of constructing fitted sheets that grip the mattress and use the actual attributes of the mattress in the fitted sheet retention process.

The corner grip uses two attributes of a variety of general mattress constructions. Many mattresses are constructed with a rigid material used to frame the upper and lower form of the mattress. The mattress is padded and a pliable and durable covering is applied and permanently affixed over the frame and padding. This invention takes advantage of the rigid frame of the mattress and the soft, pliable area that extends between the upper and lower rigid frame construction of mattresses.

This invention is a concavity or a recession in the upper corners of the fitted sheet. This invention is constructed into or on the fitted sheet along the corner. It is positioned relatively below the top of the fitted sheet and concludes in the area along the mattress corner. This invention when incorporated into a fitted sheet will rest in the pliable area of the mattress corner. Moreover, when this invention is uniformly applied to all four corners of the fitted sheet there is tension created that deters sheet movement in an upwards direction.

This new invention is constructed and accomplished in a variety of methods. One embodiment of this invention is to create a concavity by removing a portion of material from each of the adjacent side and end panels of the four corners of a fitted sheet before adjoining the corners. This concavity is in relation to the substantially perpendicular or convexed nature of the corner seam construction. The concavity commenses along the seam below the top of the sheet at some distant. the curvilinear nature of the concavity is not necessarily uniform. And the concavity concludes along the seam below the commensement point and before the end of the corner seam. These reliefs are substantially uniform along each of the side and end panels. When the adjacent seams are adjoined the concavity is apparent in relation to the general nature of the corner seam.

Another embodiment for this invention is to cause a relief in the fitted sheet corner by creating folds in the side and end panels in and around the corner region. These folds are positioned in a similar manner in the corner as illustrated in the prior embodiment. Each fold is relatively equidistant from the corner seam. The folds run perpendicular to the top of the fitted sheet. The top of the fold commenses relatively below the top of the sheet at some distance. The fold concludes below the commensement point of the fold and above the bottom edge of the associated side or end panel. A body of material or an applique of similar size to the recessed area is sewn into the corner region over the folds and the corner seam.

This new invention can be constructed in a variety of ways and means and with a variety of materials and fabrics. Other objects, features and advantages of this invention will be apparent from the following detailed description taken in connection with the accompanying drawings.

DESCRIPTION OF THE DRAWINGS

For the purpose of illustrating the invention, there is a series of drawings that demonstrate various forms that are presently preferred, it being understood, that this invention is not limited strictly as illustrated and may be imbodied in a variety of forms.

FIG. 6 is sewn into the corner.

DETAILED DESCRIPTION OF THE INVENTION

To understand the present invention refer to the drawings wherein like numerals designate like elements.

Figure 1:
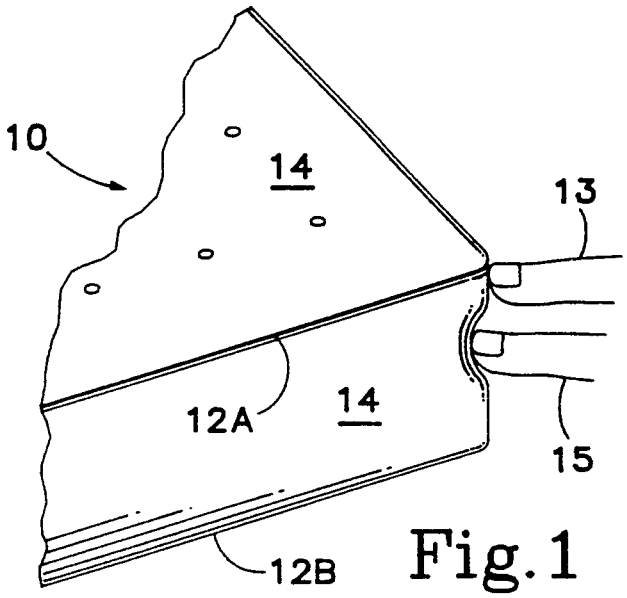
FIG. 1 is a perspective view of a mattress corner that demonstrates the required attributes of a mattress that is necessary for this invention.

FIG. 1 is a corner perspective of a conventional spring type constructed mattress designated by the numeral 10. This type of mattress has two rigid structures that form the upper and lower frames of the mattress. 12A and 12B designate the relative position of the rigid frame. Numeral 14 designates the pliable and durable covering that is permanently affixed and covers all sides of the mattress 10. A depiction of a human finger 13 is pressing the corner of the mattress at the location where 12A is located. This demonstration illustrates the rigidity at this position. A depiction of a human finger 15 is pressing the corner below 12A. This illustration demonstrates the pliable nature of the corner below the rigid frame located at 12A. FIG. 1 is a general illustration of the functioning properties in use by the present invention.

Figure 2:
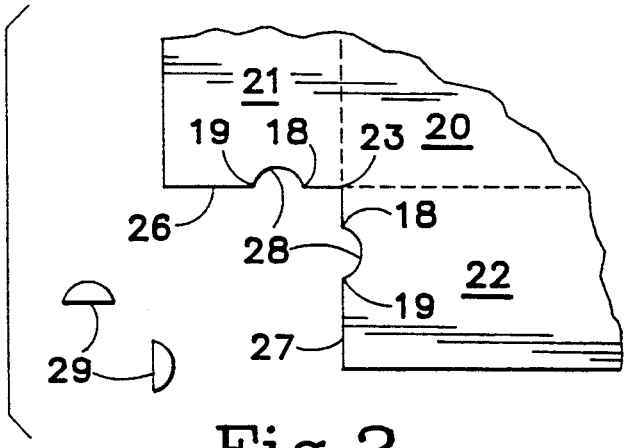
FIG. 2 is a partial corner view of a fitted sheet that has the invention included in the corner construction by removing a material portion.

FIG. 2 is a partial view of a fitted sheet that is comprised of a top panel designated by numeral 20, a side panel 21, and an end panel 22. The side panel 21 and the end panel 22 meet at the corner designated by numeral 23. The adjacent edges 26 and 27 are formed in such a manner when adjoined to create a corner, the corresponding corner seam will approximate a perpendicular angle to the top of the fitted sheet 20. Numeral 28 designates a recess created by the removal of material 29 from the side panel 21 and the end panel 22. These recesses 28 are curvilinear by nature and create a concavity with relation to edges 26 and 27. The recesses 28 commense at equidistant points designated as numeral 18 from the top of the corner 23. The recesses 28 end at 19. Numeral 19 designates the lower point of the recess in relation to the top corner 23.

Figure 3:
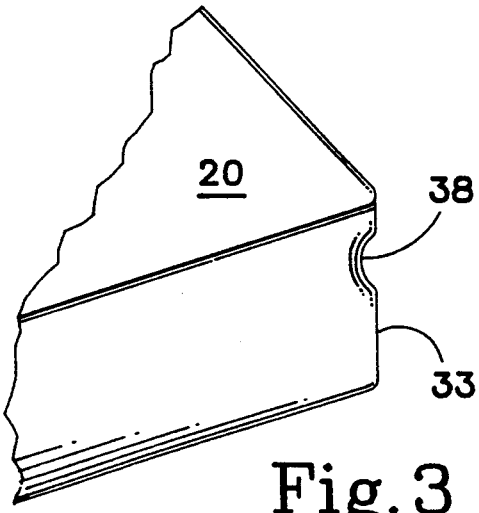
FIG. 3 is a perspective corner view of FIG. 2 after the corner edges are adjoined and the sheet is applied to a mattress corner.

FIG. 3 illustrates the sheet described in FIG. 2 when edges are adjoined and placed on a mattress as described in FIG. 1. Numeral 38 illustrates the effect this invention has on the mattress corner. Seam 33 remains relatively perpendicular to the top panel 20 with the exception at 38.

Figure 4:
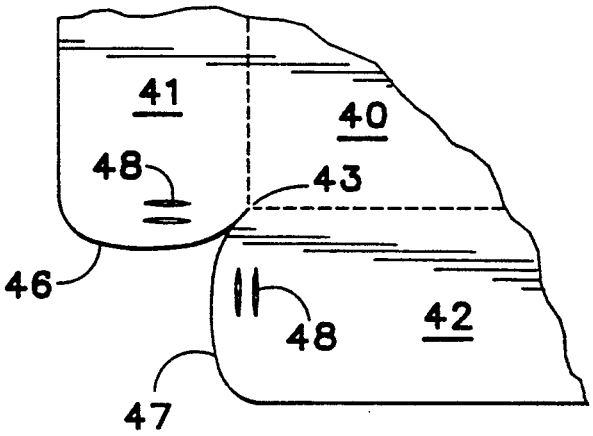
FIG. 4 is a partial corner view of a fitted sheet that has the folds included in the side and end panel.
Figure 5:
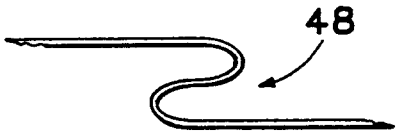
FIG. 5 illustrates the folding process of sheet fabric or material.
Figure 6:
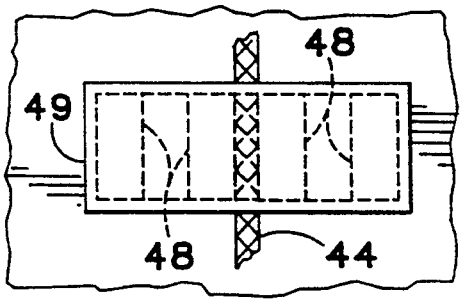
FIG. 6 is a partial view of the corner seam of the fitted sheet illustrating the material applique attached over the material folds of FIG. 4 and over the adjoined seam.

FIG. 4 is partial view of a fitted sheet construction of which is comprised of a top panel 40, a side panel 41 and an end panel 42. The adjacent edges of 41 and 42 are of a curvilinear nature that is convexed to the perpendicular plane of a mattress corner. The curvilinear aspects of the adjacent edges 46 and 47 are not disturbed. A series of folds 48 are formed and permanently affixed in the side panel 41 and the end panel 42. These folds 48 are below the corner 43. FIG. 5 demonstrates the material fold depicted by numeral 48 in FIG. 4. Each fold on the side 41 has a corresponding fold on end panel 42. FIG. 6 pictures a portion of the corner seam 44 when adjacent edges 46 and 47 are adjoined. An applique of materials depicted by numeral 49 is applied over folds 48 and over seam 44 and permanently affixed.

Figure 7:
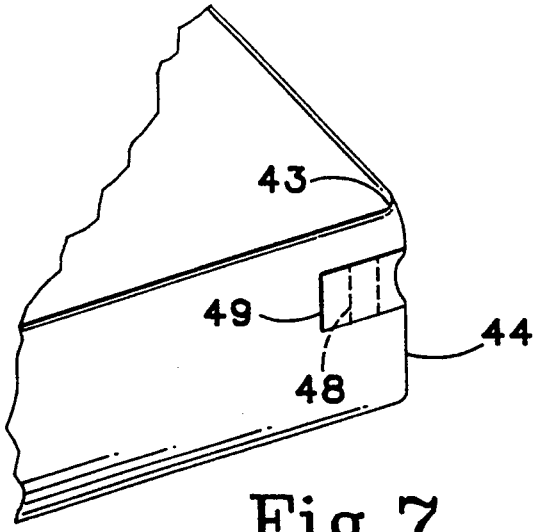
FIG. 7 is a perspective view of FIG. 4 after the corner edges of the fitted sheet are adjoined and a material applique

FIG. 7 is a perspective view of FIG. 4 after the adjacent seams are adjoined and the resulting fitted sheet is placed on a mattress as described in FIG. 1. An applique of fabric materials 49 has been affixed to the underside of the corner and is placed over the seam 44 and the material folds 48.

This art can be applied to varying sizes of mattress covers and to varying depths of mattress profiles with similar results as described above. The current invention restricts movement of the fitted sheet in such a way that the fitted sheet is not fully reliant on the corner seams or the bottoms of the side and end panels or a variety of elastic materials as the sole retention process of the fitted sheet. Likewise the current invention interacts with the mattress as the mattress becomes distorted as is the case when the fitted sheet and the mattress are in the intended use.

I claim:

1. A fitted bedding cover for a mattress comprising:

a top panel;

a side panel attached to said top panel and having a side panel edge at an end thereof;

an end panel attached to said top panel and having an end panel edge at an end thereof; and wherein said edges are joined to one another to form a seam at a corner of the cover, said seam having a concave structure including a recess therein for gripping the mattress, wherein said recess is formed in said seam between said edges.

2. The cover of claim 1 wherein said recess is formed by removing a portion of the material in said side panel and said end panel adjacent said panel edges.

3. The cover of claim 1 wherein said concave structure includes a series of folds which are formed in said side panel and said end panel thereby forming a concavity in the seam.

4. The cover of claim 3 which includes an applique which is affixed over said folds and said seam.

5. The cover of claim 4 wherein said edges of said side panel and said end panels are formed with a convex shape.

* * * * *